US008490583B1

(12) United States Patent
Gardenier

(10) Patent No.: US 8,490,583 B1
(45) Date of Patent: Jul. 23, 2013

(54) INTERNAL COMBUSTION ENGINE ENHANCEMENT SYSTEM

(76) Inventor: Ransen Gardenier, Troy, NY (US)

( * ) Notice: Subject to any disclaimer, the term of this patent is extended or adjusted under 35 U.S.C. 154(b) by 618 days.

(21) Appl. No.: 12/267,140

(22) Filed: Nov. 7, 2008

Related U.S. Application Data

(60) Provisional application No. 61/022,347, filed on Jan. 20, 2008, provisional application No. 61/058,591, filed on Jun. 4, 2008.

(51) Int. Cl.
*F02B 77/04* (2006.01)
*F02B 43/00* (2006.01)

(52) U.S. Cl.
USPC ..... 123/1 A; 123/198 A

(58) Field of Classification Search
USPC ..... 123/1 A, 198 A, 196 R
See application file for complete search history.

(56) References Cited

U.S. PATENT DOCUMENTS 2,313,896 A * 3/1943 Scheble ..... 210/167.02

* cited by examiner

*Primary Examiner* — Noah Kamen
(74) *Attorney, Agent, or Firm* — Sinorica, LLC

(57) ABSTRACT

An internal combustion engine enhancement system for increasing vehicle fuel mileage over a duration of a plurality of tanks of fuel used in a vehicle. The internal combustion engine enhancement system generally includes a fuel additive which includes a volume of carrier fluid and a plurality of fine particles within the carrier fluid. The carrier fluid with the fine particles is added to the fuel in the fuel tank of a vehicle. The fine particles are reduced in size to nanoparticles by dissolving and abrading to less than 1,000 nanometers where after they are transferred to the engine during normal operation of the engine. The nanoparticles lubricate the engine components and fill in voids within the sleeve to increase engine lubricity. Alternatively, larger particles (e.g. 0.25 inches in size) may be added to the fuel where fine particles and nanoparticles are created via abrading and dissolving.

20 Claims, 6 Drawing Sheets

INTERNAL COMBUSTION ENGINE ENHANCEMENT SYSTEM

CROSS REFERENCE TO RELATED APPLICATIONS

I hereby claim benefit under Title 35, United States Code, Section 119(e) of U.S. provisional patent application Ser. No. 61/022,347 filed on Jan. 20, 2008 and Ser. No. 61/058,591 filed Jun. 4, 2008. The 61/022,347 application and 61/058,591 are currently pending. The 61/022,347 application and 61/058,591 application are hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to fuel additives for vehicles and more specifically it relates to an internal combustion engine enhancement system for increasing vehicle fuel mileage over a duration of a plurality of tanks of fuel used in a vehicle.

2. Description of the Related Art

Any discussion of the related art throughout the specification should in no way be considered as an admission that such related art is widely known or forms part of common general knowledge in the field.

Conventional fuel additives increase the fuel efficiency of a vehicle by increasing the lubricity of the fuel and/or efficiency of burning the fuel in the engine. An example of a fuel additive represented to increase better burning fuel efficiency of a vehicle is adding acetone ($CH_3COCH_3$) to fuel which is believed to aid in the vaporization of the fuel.

All of these fuel additives are somewhat effective, but there is no question that their effect is limited solely to the tank of fuel they are added to—requiring additional fuel treatments the next time the fuel tank is filled. It is time consuming and costly to add a fuel additive to each tank of fuel. In addition, many individuals fill up their fuel tank prior to the fuel tank being empty resulting in excessive and wasted fuel additive usage.

Because of the inherent problems with the related art, there is a need for a new and improved internal combustion engine enhancement system for increasing vehicle fuel mileage over a duration of a plurality of tanks of fuel used in a vehicle.

BRIEF SUMMARY OF THE INVENTION

The general purpose of the present invention is to provide an internal combustion engine enhancement system that has many of the advantages of the fuel additive mentioned heretofore. The invention generally relates to a fuel additive which includes a volume of carrier fluid and a plurality of fine particles within the carrier fluid. The carrier fluid with the fine particles is added to the fuel in the fuel tank of a vehicle. The fine particles are reduced in size to nanoparticles by dissolving and abrading to less than 1,000 nanometers where after they are transferred to the engine during normal operation of the engine. The nanoparticles lubricate the engine components and fill in voids within the sleeve to increase engine lubricity. The nanoparticles may be comprised of various types of materials such as but not limited to copper, polycarbonate and acrylic. Alternatively, larger particles (e.g. 0.25 inches in size) may be added to the fuel where fine particles and nanoparticles are created via abrading and dissolving.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide an internal combustion engine enhancement system for increasing vehicle fuel mileage over a duration of a plurality of tanks of fuel used in a vehicle.

Another object is to provide an internal combustion engine enhancement system that may be utilized within various types of internal combustion engines.

An additional object is to provide an internal combustion engine enhancement system that reduces the costs of driving a vehicle.

A further object is to provide an internal combustion engine enhancement system that increases fuel mileage for more than one tank full of fuel.

Another object is to provide an internal combustion engine enhancement system that is easily added to the fuel of a vehicle (e.g. gas, diesel).

A further object is to provide an internal combustion engine enhancement system that reduces the friction within the engine components for extended periods of time.

Another object is to provide an internal combustion engine enhancement system that increases cylinder compression ratios by filling in microscopic voids in the sleeve of a vehicle engine.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
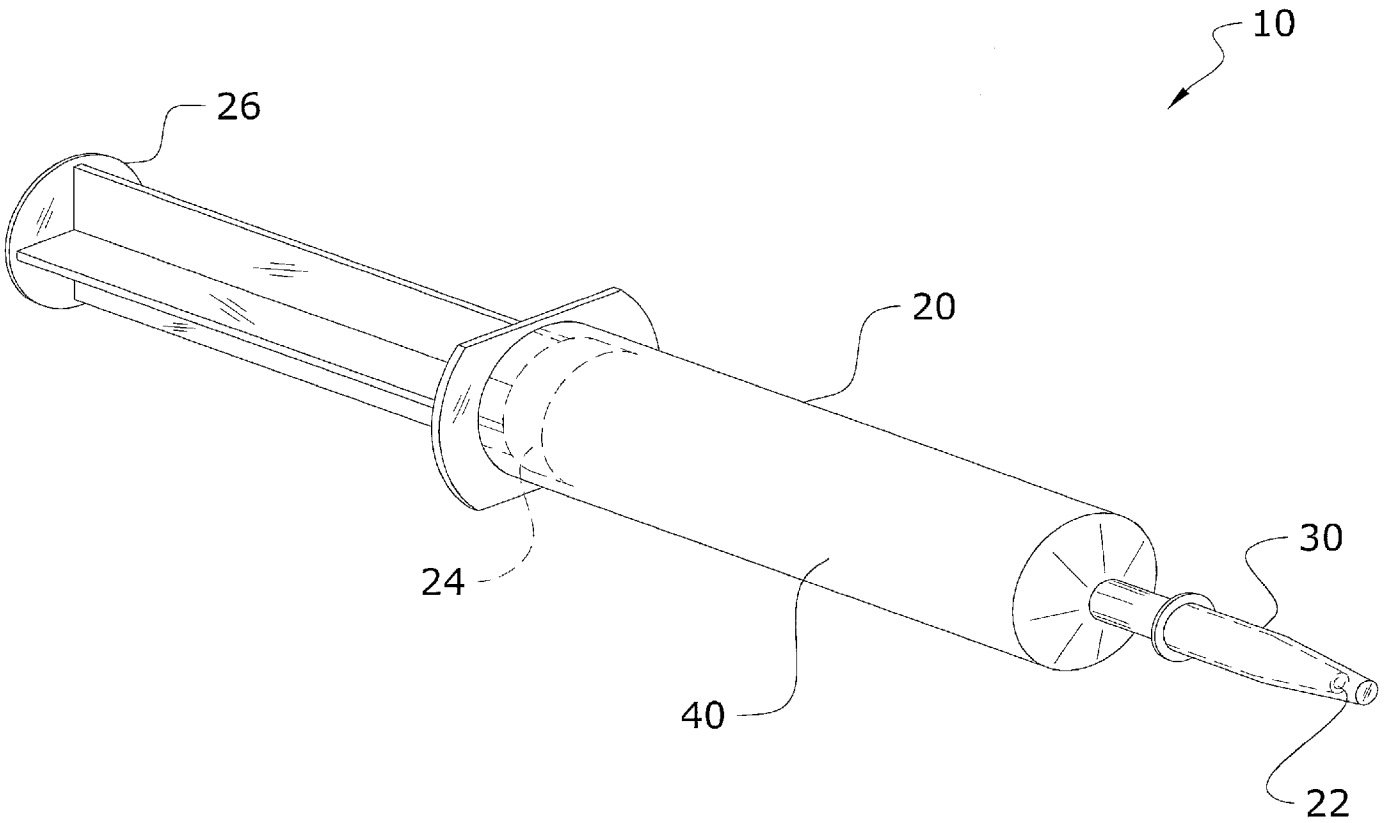
FIG. 1 is an upper perspective view of the present invention within a dispensing unit.

Turning now descriptively to the drawings, in which similar reference characters denote similar elements throughout the several views, FIGS. 1 through 5 illustrate an internal combustion engine enhancement system 10, which comprises a fuel additive which includes a volume of carrier fluid and a plurality of fine particles within the carrier fluid. The carrier fluid with the fine particles is added to the fuel in the fuel tank of a vehicle. The fine particles are reduced in size to nanoparticles by dissolving and abrading to less than 1,000 nanometers where after they are transferred to the engine during normal operation of the engine. The nanoparticles lubricate the engine components and fill in voids 16 within the sleeve 12 to increase engine lubricity. The nanoparticles may be comprised of various types of materials such as but not limited to brass, copper, polycarbonate and acrylic. Alternatively, larger particles (e.g. 0.25 inches in size) may be added to the fuel where fine particles and nanoparticles are created via abrading and dissolving.

B. Dispensing Unit

Figure 2:
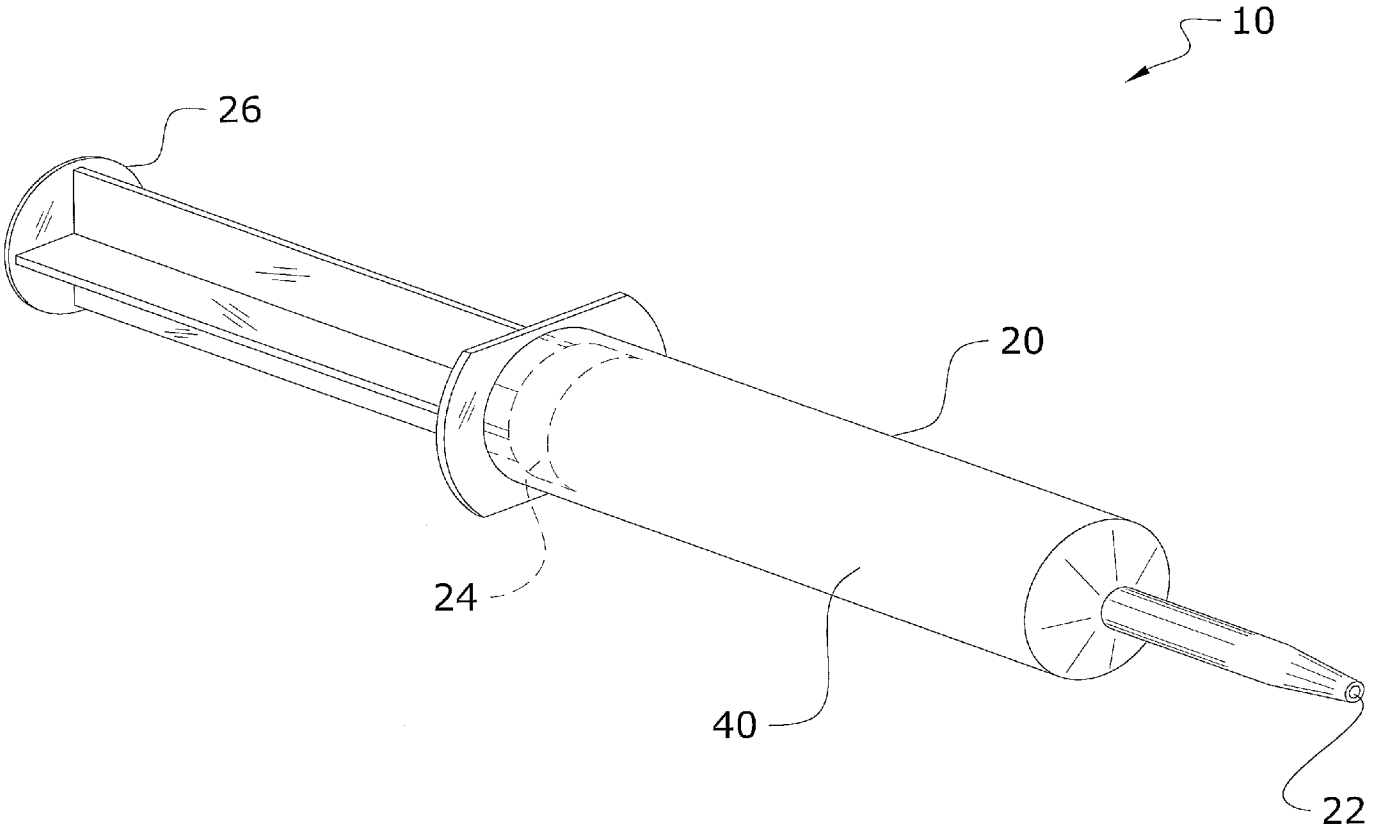
FIG. 2 is an upper perspective view of the dispensing unit with the cover removed.

FIGS. 1 and 2 illustrate an exemplary dispensing unit 20 having a dispensing nozzle 22 and a plunger 24 within the body of the dispensing unit 20 having a structure similar to a medical syringe. A handle 26 is attached to the plunger 24 to allow a user to extend the plunger 24 through the interior tube of the dispensing unit 20 thereby expelling the lubricating composition 40 outwardly from the dispensing nozzle 22. The plunger 24 ensures that all of the lubricating composition 40 is dispensed from the dispensing unit 20.

A cover 30 is preferably removably attached to the dispensing nozzle 22 to retain the lubricating composition 40 within the dispensing unit 20. Various other types of dispensing units 20 may be utilized with the present invention to dispense the lubricating composition 40.

C. Lubricating Composition

The lubricating composition 40 stored within the dispensing unit 20 is comprised of a carrier fluid and a plurality of fine particles. The carrier fluid may be comprised of any fluid capable of suspending the fine particles within such as but not limited to oil (e.g. light oil).

At least a portion of the plurality of fine particles have a size of at least 1,000 nanometers. A portion or all of the plurality of fine particles may have a size of less than 1,000 nanometers. The fine particles preferably are comprised of a rounded spherical structure initially, however the fine particles may be comprised of a non-rounded structure.

It is preferable that at least a portion of the fine particles have a size of at least 1,000 nanometers. When the fine particles have a size of at least 1,000 nanometers this allows for the delayed release of the fine particles based upon the abrading and dissolving of the fine particles which reduces their size below 1,000 nanometers allowing them to be suspended within the fuel (e.g. gas, ethanol, diesel) and thereafter transferred to the internal combustion engine via the fuel being transferred to the internal combustion engine.

The fine particles are preferably comprised of a material that is soluble in the fuel (e.g. brass or copper). When the fine particles are comprised of a material soluble in the fuel, then the fine particles are reduced in size to nanoparticles via abrading action in conjunction with dissolving until the nanoparticles are suspended within the fuel via Brownian motion. The fine particles may also be comprised of a thermoplastic polymer such as but not limited to polycarbonate. The fine particles may also be comprised of a synthetic polymer or thermoplastic such as acrylic (e.g. acrylic glass).

D. Alternative Embodiment

Larger Particles

Figure 4:
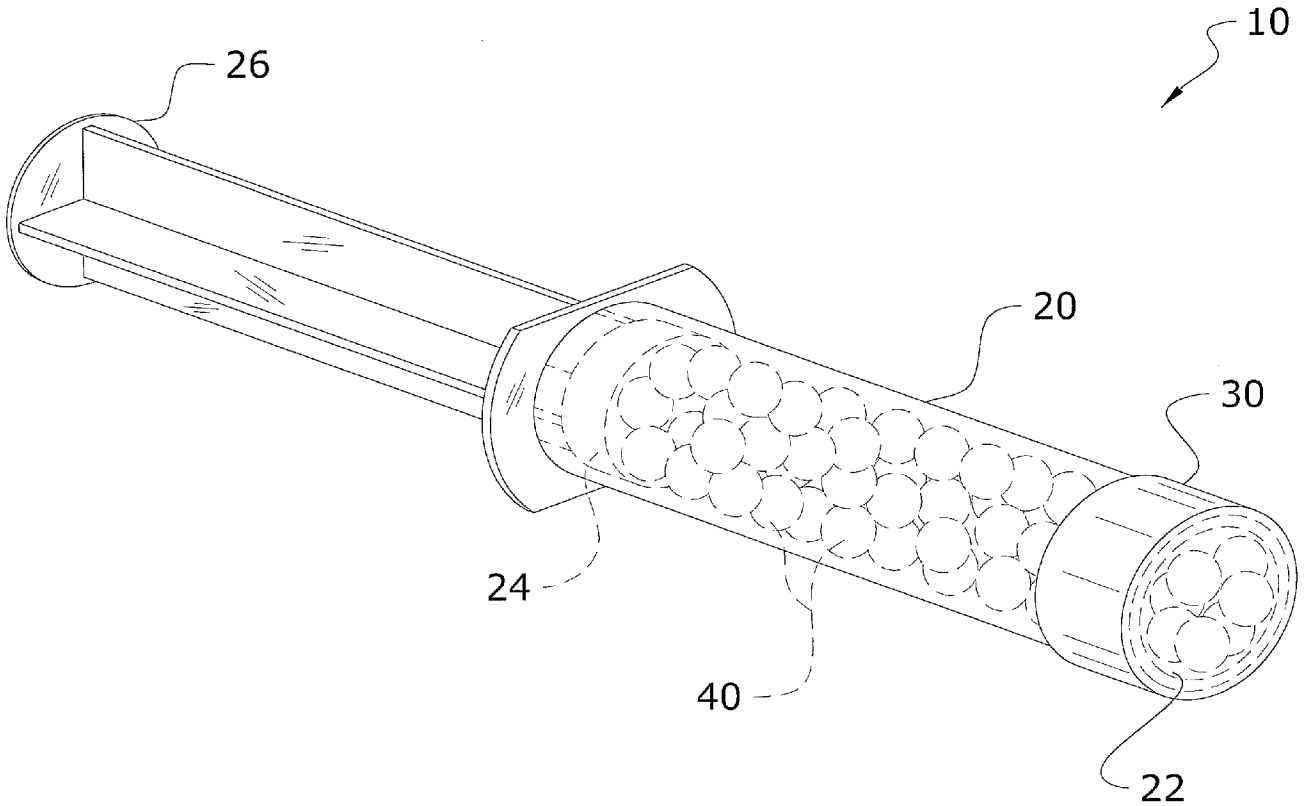
FIG. 4 is an upper perspective view of an alternative embodiment dispensing unit with a plurality of acrylic balls.
Figure 5:
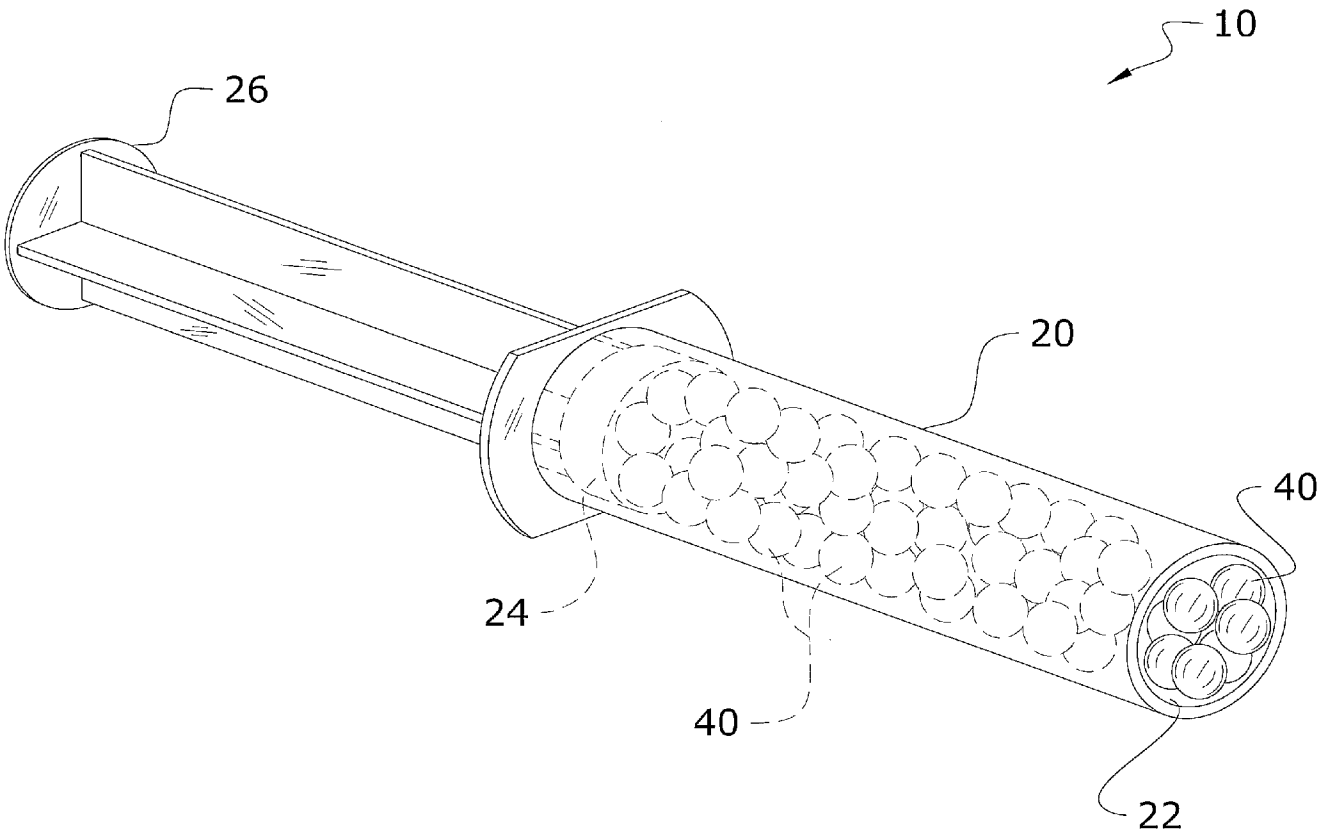
FIG. 5 is an upper perspective view of the cover removed from the alternative embodiment dispensing unit for dispensing the acrylic balls.

FIGS. 4 and 5 illustrate an alternative embodiment wherein the lubricating composition 40 is comprised of a plurality of larger particles (e.g. 0.25 inches in size) that are enclosed in an alternative dispensing unit 20. The dispensing unit 20 includes a larger dispensing nozzle 22 to allow the larger particles to be dispensed as best illustrated in FIG. 5 of the drawings. The cover 30 may be comprised of any cover capable of securing the larger particles within the dispensing unit 20.

The larger particles are preferably comprised of a larger size (e.g. 0.25 inches in size) and therefore do not require a carrier fluid. The larger particles are also substantially spherical to assist in dispensing from the dispensing unit 20 and to assist in movement within the fuel tank during movement of the vehicle. The larger particles may be comprised of various types of materials such as but not limited to brass, copper, polycarbonate and acrylic. The larger particles are directly input into the fuel of the fuel tank where the larger particles move around at the bottom of the fuel tank during operation of the vehicle resulting in dissolving and abrading of the larger particles into both fine particles and nanoparticles. The fine particles are further dissolved and/or abraded to a nanoparticles size of less than 1,000 nanometers resulting in the particles moving within the fuel via Brownian motion.

E. Alternative Embodiment

Direct Application to Fuel Tank

Another alternative embodiment of the present invention is comprised of securing the fine particles and/or nanoparticles to the interior surface of the fuel tank at the time of manufacturing the vehicle. The fine particles and/or nanoparticles may be attached to the inner surface of the fuel tank via paint or other adhesive that allows for the slow release of the particles into the fuel over time.

F. Operation of Present Invention

In operation, the user first positions the dispensing nozzle 22 within an intake opening of a fuel tank of a vehicle. The user then manipulates the plunger 24 within the dispensing unit 20 to expel the lubricating composition 40 from the dispensing nozzle 22 into the fuel tank. The user may add additional fuel to the fuel tank to ensure that the lubricating composition 40 is completely mixed within the volume of fuel within the fuel tank. The lubricating composition 40 mixes with the volume of fuel and the plurality of fine particles and/or larger particles deposit on a bottom of the fuel tank. Any of the particles having a size less than 1,000 nanometers will move within the fuel via Brownian motion.

Figure 3A:
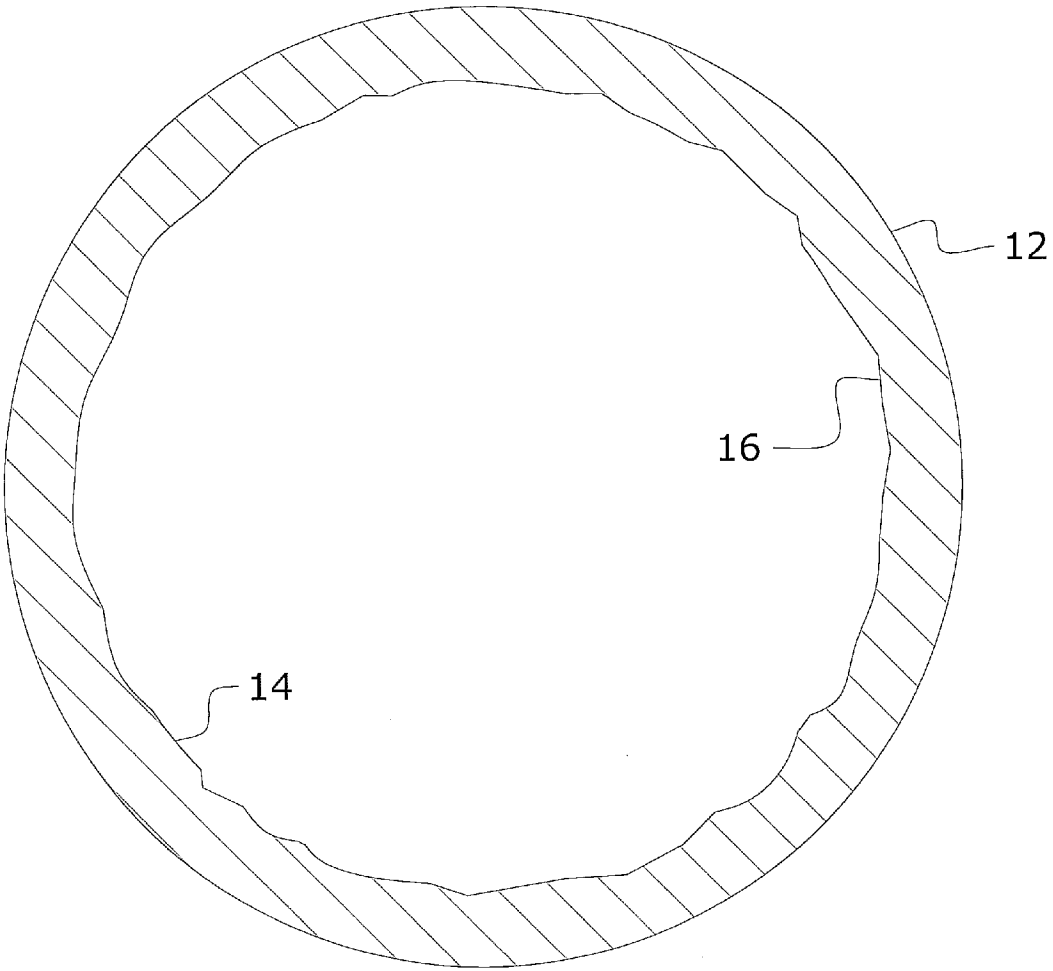
FIG. 3*a* is a cross sectional view of a sleeve prior to treatment with the present invention.
Figure 3B:
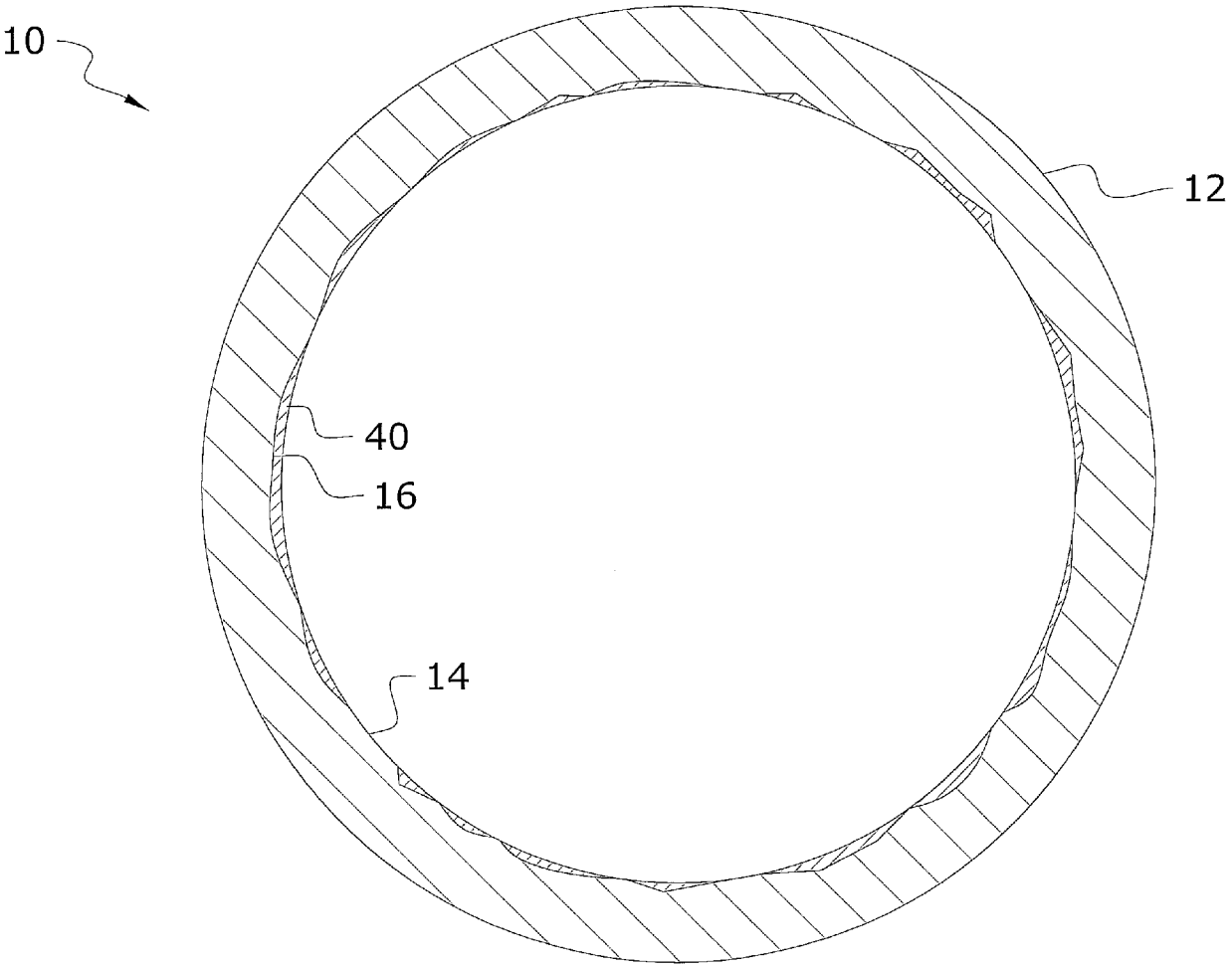
FIG. 3*b* is a cross sectional view of the sleeve after treatment with the present invention illustrating the filling of the voids in the inner surface of the sleeve with the nanoparticles.

The user then operates the vehicle normally by driving the vehicle. The movement of the vehicle creates movement of the fuel tank and the fuel within the fuel tank resulting in the particles engaging the bottom surface of the fuel tank. The engagement of the bottom surface of the fuel tank abrades the particles thereby reducing their size until they are nanoparticles comprised of a size less than 1,000 nanometers when they will float within the fuel. The nanoparticles are delivered via a fuel delivery system of the vehicle to the internal combustion engine of the vehicle where internal engine combustion occurs with the nanoparticles within the cylinder. The nanoparticles are released from the fuel in the combustion cylinder during the vaporization of the fuel and are deposited on the inner surface 14 of the sleeve 12. The nanoparticles deposited on the inner surface 14 of the sleeve 12 eventually fill in the voids 16 (e.g. pits, scratches and other imperfections) within the inner surface 14 of the sleeve 12 thereby increasing the compression ratio of the internal combustion engine as illustrated in FIG. 3*b* of the drawings. A portion of the nanoparticles remain on the inner surface 14 of the sleeve 12 providing a lubricating effect to the piston and rings moving within the sleeve 12 by reducing the friction of the same within the sleeve 12.

During continued operation, the nanoparticles will eventually be removed from the sleeve 12 via the exhaust of the cylinder and/or collection within the oil of the internal combustion engine. After the nanoparticles have reduced in number, the user may treat the internal combustion engine again as necessary to regain fuel efficiency and engine power.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A method of applying nanoparticles to an interior of an internal combustion engine to increase the efficiency of said internal combustion engine, said method comprising:

providing a lubricating composition comprised of a plurality of particles, wherein at least a portion of said plurality of particles have a size of at least 1,000 nanometers;

dispensing said lubricating composition within a volume of fuel in a fuel tank of a vehicle;

allowing said lubricating composition to mix with said volume of fuel, wherein said plurality of particles deposit on a bottom of said fuel tank;

driving said vehicle thereby creating movement of said fuel tank and abrading said plurality of particles to create a plurality of nanoparticles having a size less than 1,000 nanometers;

transferring a portion of said plurality of nanoparticles via a fuel delivery system of said vehicle to an internal combustion engine of said vehicle; and lubricating said internal combustion engine with said portion of said plurality of nanoparticles.

2. The method of applying nanoparticles to an interior of an internal combustion engine of claim 1, wherein said plurality of particles are comprised of brass or copper.

3. The method of applying nanoparticles to an interior of an internal combustion engine of claim 1, wherein said plurality of particles are comprised of acrylic.

4. The method of applying nanoparticles to an interior of an internal combustion engine of claim 1, wherein said plurality of particles are comprised of polycarbonate.

5. The method of applying nanoparticles to an interior of an internal combustion engine of claim 1, wherein said portion of said plurality of nanoparticles fill in voids within a sleeve of said internal combustion engine.

6. The method of applying nanoparticles to an interior of an internal combustion engine of claim 1, wherein said plurality of particles are soluble in a fuel.

7. The method of applying nanoparticles to an interior of an internal combustion engine of claim 1, wherein said nanoparticles are comprised of a substantially spherical structure.

8. The method of applying nanoparticles to an interior of an internal combustion engine of claim 1, wherein said carrier fluid is comprised of an oil.

9. The method of applying nanoparticles to an interior of an internal combustion engine of claim 1, wherein said portion of said plurality of particles are suspended within said fuel via Brownian motion.

10. The method of applying nanoparticles to an interior of an internal combustion engine of claim 1, wherein said plurality of nanoparticles decrease friction within said internal combustion engine.

11. A method of applying nanoparticles to an interior of an internal combustion engine to increase the efficiency of said internal combustion engine, said method comprising:

providing a dispensing unit with a dispensing nozzle and a plunger;

providing a lubricating composition within said dispensing unit, wherein said lubricating composition is comprised of a carrier fluid and a plurality of fine particles, wherein at least a portion of said plurality of fine particles have a size of at least 1,000 nanometers;

position said dispensing nozzle within an intake opening of a fuel tank of a vehicle;

manipulating said plunger within said dispensing unit to expel said lubricating composition from said dispensing nozzle into said fuel tank, wherein said fuel tank includes a volume of fuel;

allowing said lubricating composition to mix with said volume of fuel, wherein said plurality of fine particles deposit on a bottom of said fuel tank;

driving said vehicle thereby creating movement of said fuel tank and abrading said plurality of fine particles to create a plurality of nanoparticles having a size less than 1,000 nanometers;

transferring a portion of said plurality of nanoparticles via a fuel delivery system of said vehicle to an internal combustion engine of said vehicle; and lubricating said internal combustion engine with said portion of said plurality of nanoparticles.

12. The method of applying nanoparticles to an interior of an internal combustion engine of claim 11, wherein said plurality of fine particles are comprised of brass.

13. The method of applying nanoparticles to an interior of an internal combustion engine of claim 11, wherein said plurality of fine particles are comprised of copper.

14. The method of applying nanoparticles to an interior of an internal combustion engine of claim 11, wherein said plurality of fine particles are comprised of polycarbonate.

15. The method of applying nanoparticles to an interior of an internal combustion engine of claim 11, wherein said portion of said plurality of nanoparticles fill in voids within a sleeve of said internal combustion engine.

16. The method of applying nanoparticles to an interior of an internal combustion engine of claim 11, wherein said plurality of fine particles are soluble in a fuel.

17. The method of applying nanoparticles to an interior of an internal combustion engine of claim 11, wherein said nanoparticles are comprised of a substantially spherical structure.

18. The method of applying nanoparticles to an interior of an internal combustion engine of claim 11, wherein said carrier fluid is comprised of an oil.

19. The method of applying nanoparticles to an interior of an internal combustion engine of claim 11, wherein said portion of said plurality of fine particles are suspended within said fuel via Brownian motion.

20. The method of applying nanoparticles to an interior of an internal combustion engine of claim 11, wherein said plurality of nanoparticles decrease friction within said internal combustion engine.

* * * * *